United States Patent [19]

Zedalis et al.

[11] Patent Number: 4,923,532

[45] Date of Patent: May 8, 1990

[54] HEAT TREATMENT FOR ALUMINUM-LITHIUM BASED METAL MATRIX COMPOSITES

[75] Inventors: Michael S. Zedalis, Randolph, N.J.; Paul S. Gilman, Suffern, N.Y.

[73] Assignee: Allied-Signal Inc., Morris Township, Morris County, N.J.

[21] Appl. No.: 242,921

[22] Filed: Sep. 12, 1988

[51] Int. Cl.[5] ..... C22F 1/04; C22C 1/09; C22C 21/00

[52] U.S. Cl. ..... 148/159; 148/3; 419/29

[58] Field of Search ..... 148/159, 3; 419/29

[56] References Cited

U.S. PATENT DOCUMENTS

| | | | |
|---|---|---|---|
| 4,409,038 | 10/1983 | Weber | 148/12.7 A |
| 4,443,249 | 4/1984 | Weber et al. | 148/11.5 P |
| 4,452,865 | 6/1984 | Yamatsuta et al. | 148/3 |
| 4,515,866 | 5/1985 | Okamoto et al. | 428/614 |
| 4,518,441 | 5/1985 | Hailey | 148/11.5 P |
| 4,532,106 | 7/1985 | Pickens | 420/542 |
| 4,594,222 | 6/1986 | Heck et al. | 148/415 |
| 4,600,556 | 7/1986 | Donachie et al. | 420/542 |
| 4,624,705 | 11/1986 | Jatkar et al. | 148/11.5 Q |
| 4,627,959 | 12/1986 | Gilman et al. | 420/533 |
| 4,643,780 | 2/1987 | Gilman et al. | 148/415 |
| 4,753,690 | 6/1988 | Wada et al. | 148/415 |
| 4,770,848 | 9/1988 | Ghosh et al. | 419/29 |
| 4,801,339 | 1/1989 | Osborn et al. | 148/415 |

FOREIGN PATENT DOCUMENTS 1458349 4/1971 Fed. Rep. of Germany ..... 419/29

*Primary Examiner*—L. Dewayne Rutledge
*Assistant Examiner*—David W. Schumaker
*Attorney, Agent, or Firm*—Ernest D. Buff; Gerhard H. Fuchs

[57] ABSTRACT

An aluminum based metal matrix composite is produced from a charge containing a rapidly solidified aluminum alloy and particles of a reinforcing material present in an amount ranging from about 0.1 to 50 percent by volume of the charge. The charge is ball milled energetically to enfold metal matrix material around each of the particles while maintaining the charge in a pulverant state. Upon completion of the ball milling step, the charge is consolidated to provide a powder compact having a formable, substantially void free mass. The mass is then subject to a heat treatment during which it is solutionized at a temperature above the solvus temperature of the alloy, quenched and age hardened at a temperature below the solvus temperature of the alloy to promote precipitation of a primary strengthening $Al_3(Li,Zr)$ phase and to precipitate substantially all of the $Al_3(Li,Zr)$ phase into the metal matrix. The composite is especially suited for use in aerospace, automotive, electronic, wear resistance critical components and the like.

19 Claims, 9 Drawing Sheets

HEAT TREATMENT FOR ALUMINUM-LITHIUM BASED METAL MATRIX COMPOSITES

BACKGROUND OF THE INVENTION

1. Field of the Invention

This invention relates to low density aluminum-lithium based metal matrix composites, and more particularly to a heat treatment for producing an aluminum-lithium composite with high hardness, strength, modulus and ductility.

2. Description of the Prior Art

An aluminum-lithium based composite generally comprises two components—an aluminum-lithium alloy matrix and a hard reinforcing second phase. The composite typically exhibits at least one characteristic reflective of each component. Ideally, an aluminum-lithium alloy matrix offers the low density, moderate ductility and high specific mechanical properties, and the high elastic modulus and abrasion resistance of the reinforcing phase.

Several aluminum-lithium based metal matrix composites prepared by ingot metallurgy techniques, e.g. melt infiltration, have been reported. In addition, there has been disclosed the preparation of aluminum-lithium based alloy systems by mechanical alloying. Such mechanical alloying techniques have been described by U.S. Pat. No. 4,594,222 as being suitable for the fabrication of aluminum-lithium based alloy powder. The technique therein taught involves the repeated fracturing and rewelding of a mixture of powder particles during high energy impact milling in a grinding or ball mill. A necessaryy prerequisite for the milling operation is said to be the presence of an organic-base processing control aid.

In some instances, mechanical alloying systems have incorporated, as reinforcing material, low volume fractions of carbides and oxide/hydroxides into the aluminum-lithium based alloy. The alloy is then hardened using heat treatments conventionally employed with monolithic aluminum-lithium base alloys, that is, heat treatments comprising the steps of solutionizing at temperatures above the solvus temperature followed by age hardening at temperatures below the solvus temperature. Such heat treatment procedures are often times complicated by the reinforcing material. When present in the aluminum alloy matrix, such reinforcing material significantly alters the aging response of the alloy. As a result, aluminum-lithium based composites have heretofore exhibited lower values of hardness, strength and ductility than those considered desirable for commercial applications.

SUMMARY OF THE INVENTION

The present invention provides a process for producing a composite material comprising the steps of forming a charge containing, as ingredients, a rapidly solidified aluminum-lithium alloy and particles of a reinforcing material selected from the group consisting of carbide, oxide, boride, carbo-boride, nitride and mixtures thereof, the reinforcing material being present in an amount ranging from about 0.1 to 50 percent by volume of the charge, and ball milling the charge energetically to enfold metal matrix material around each of the reinforcing particles while maintaining the charge in a pulverulant state. In this manner there is provided a strong bond between the matrix material and the surface of the reinforcing particle. Upon completion of the ball milling step, the resultant powder is degassed and hot pressed using conventional powder metallurgical techniques, to form a powder compact having a mechanically formable, substantially void-free mass. The compact is then mechanically worked to increase its density and provide an enginerring shape or mass. The engineering shape, or mass, is thereafter subjected to a heat treatment comprising the steps of solutionizing the mass at a temperature above the alloy's solvus temperature to dissolve substantially all of the alloying elements into the aluminum matrix; quenching the mass to retain a supersaturated aluminum-based solid solution, and age hardening the mass at a temperature below the alloy's solvus temperature for a time sufficient to promote the precipitation therein of the primary strengthening $Al_3$-(Li,Zr) phase. Age hardening of the shape is continued until substantially all of the $Al_3$(Li,Zr) phase is precipitated into the metal matrix. The aging kinetics at temperatures below the solvus temperature have been found to be strongly affected by the presence of a secondary particulate or fibrous reinforcement present in the aluminum-lithium based alloy composite.

The present invention advantageously provides for a heat treatment of aluminum-lithium based alloys containing varied amounts of particulate or fibrous reinforcement. Once incorporated into the aluminum-lithium based matrix, the particulate or fibrous reinforcement material provides the engineering shape fabricated therefrom with characteristics reflective of each component. The matrix material provides low density, moderate ductility and toughness while the reinforcement provides high strength and modulus as well as increased abrasion resistance and hardness. Aging times are decreased and process costs are reduced. The heat treated composite evidences high values of hardness, strength and ductility, together with excellent stiffness and abrasion resistance, which represent, in combination, a substantial improvement over properties produced by processing monolithic or reinforced aluminum-lithium base components in the conventional way. Such properties make the heat treated composites of the invention especially suited for use in aerospace components such as stators, actuator casings, electronic housings and other wear resistance critical parts, automotive components such as piston heads, valve seats and stems, connecting rods, cam shafts, brake shoes and liners, tank tracks, torpedo housings, radar antennae, radar dishes, space structures, sabot casings, tennis racquets, golf club shafts and the like.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

Figure 1A:
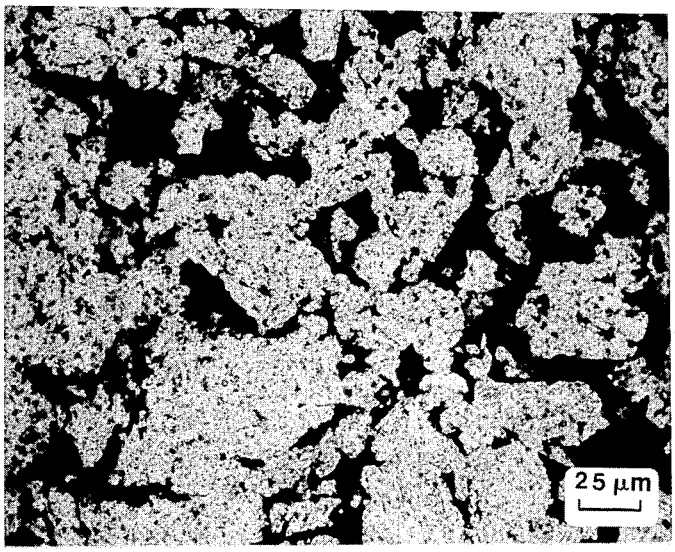
FIGS. 1A and 1B are photomicrographs of rapidly solidified aluminum based, lithium, zirconia, copper and magnesium containing alloy powder having, respectively, 5 and 15 percent by volume silicon carbide particulate substantially uniformly distributed therein in accordance with the present invention.

The aluminum base, rapidly solidified alloy appointed for use in the process of the present invention has a composition consisting essentially of the formula $Al_{bal.}Li_aZr_bMg_cT_d$, wherein T is at least one element selected from the group consisting of Cu, Si, Sc, Ti, B, Hf, Be, Cr, Mn, Fe, Co and Ni, "a" ranges from about 9.0–17.75 at%, "b" ranges from about 0.05–0.75 at%, "c" ranges from about 0.45–8.5 at% and "d" ranges from about 0.05–13 at%, the balance being aluminum plus incidental impurities.

The rapidly solidified ribbon is the product of a melt spinning process selected from the group consisting of jet casting or planar flow casting. In such processes, which are conventional, the melt spun ribbon is produced by injecting and solidifying a liquid metal stream onto a rapidly moving substrate. The ribbon is thereby cooled by conductive cooling rates of at least about $10^{5°}$ C./sec and preferably in the range of $10^{5°}$ to $10^{7°}$ C./sec. Such processes typically produce homogeneous materials, and permit control of chemical composition by providing for incorporation of strengthening dispersoids into the alloy at sizes and volume fractions unattainable by conventional ingot metallurgy. The aluminum matrix material must be provided as a particulate that can range in size from 0.64 cm in diameter down to less than 0.0025 cm in diameter. For the purposes of this specification and claims the term "hard", as applied to the particle which may form reinforcing phase of the resultant composite shall generally imply (1) a scratch hardness in excess of 8 on the Rigeway's Extension of the MOHS' scal of Hardness, and (2) an essentially nonmalleable character. However, for the aluminum matrices of this invention somewhat softer reinforcing particles such as graphite particles may be useful. Hard particles useful in the process of this invention include filamentary or non-filamentary particles of silicon carbide, aluminum oxide/hydroxide (including additions thereof due to its formation on the surface of the aluminum matrix material), zirconia, garnet, cerium oxide, yttria, aluminum silicate, including those silicates modified with fluoride and hydroxide ions, silicon nitride, boron nitride, boron carbide, simple or mixed carbides, borides, carboborides and carbonitrides of tantalum, tungsten, zirconium hafnium and titanium, and intermetallics such as $Al_3Ti$, AlTi, $Al_3$(V, Zr, Nb, Hf and Ta) $Al_7V$, $Al_{10}V$, $Al_3Fe$, $Al_6Fe$, $Al_{10}Fe_2Ce$, and $Al_{12}$(Fe, Mo, V, Cr, Mn)$_3$Si. In particular, because the present invention is concerned with aluminum-lithium based composites that possess a relatively low density and high modulus, silicon carbide and boron carbide are desirable as the reinforcing phase. However, other particulate reinforcements may prove to form superior matrix/reinforcement bonds. Also, the present specification is not limited to single types of reinforcement or single phase matrix alloys.

The term "energetic ball milling" in the context of the present specification and claims means milling at prescribed conditions where the energy intensity level is such that the hard reinforcing phase is optimately kneaded into the aluminum matrix. As used herein, the phrase "prescribed conditions" means conditions such that the ball mill is operated to physically deform, cold weld and fracture the matrix metal alloy powder so as to distribute the reinforcing phase therewithin. The phrase "optimately kneaded", as used herein, means that the reinforcing phase is distributed more uniformly than the distribution produced by simple mixing or blending, and approaches a substantially uniform and, most preferably, a substantially homogeneous distribution of reinforcing material within the matrix. Energetic ball mills include vibratory mills, rotary ball mills and stirred attritor mills. As opposed to mechanical alloying where special precautions must be taken so that cold welding of matrix particles into large agglomerates is minimized by the addition of processing aids, i.e., organic waxes such as stearic acid, the present specification and claims describe a process where energetic ball milling is carried out without the addition of any processing aids. The ability to process a fine and uniform dispersion of the reinforcing phase into the aluminum matrix is a direct consequence of starting with rapidly solidified aluminum alloys. Rapid solidification of those alloys is accomplished in numerous ways, including planar flow or jet casting methods, melt extraction, splat quenching, atomization techniques and plasma spray methods.

These metal alloy quenching techniques generally comprise the step of cooling a melt of the desired composition at a rate of at least about $10^{5°}$ C./sec. Generally, a particular composition is selected, powders or granules of the requisite elements in the desired portions are melted and homogenized, and the molten alloy is rapidly quenched on a chill surface, such as a rapidly moving metal substrate, an impinging gas or liquid.

When processed by these rapid solidification methods the aluminum alloy is manifest as a ribbon, powder or splat of substantially uniform structure. This substantially uniforly structured ribbon, powder or splat may then be pulverized to a particulate for further processing. By following this processing route to manufacture the aluminum matrix, the resulting aluminum particulate has properties that make it amenable to energetic ball milling to disperse the reinforcing phase without the addition of a processing control agent. These enhanced properties may include good room and elevated temperature strength and good fracture toughness. Furthermore, no processing aid is required, with the result that special degassing treatments heretofore employed to decompose the processing aid and out-gas its gaseous components, are not necessary. Degassing sequences of the type eliminated by the process of the present invention are time and energy consuming. For if the residual processing aid required by prior milling process is not completely broken down and its gaseous components are not removed, the composite's properties may be adversely affected causing, for example, blistering of the composite upon exposure thereof to high temperatures. Further, with the present invention, introduction of residual elements such as carbon, from the processing aid, which can adversely affect properties of the final product are avoided.

After reinforcement is completed, the resultant powder is compacted alone or mixed with additional matrix material under conditions conventionally used in the production of powder metallurgical bodies from the matrix material. Consequently, the resultant composite compact is vacuum hot pressed or otherwise treated under conditions typically employed for the matrix material, the conditions being such that no significant melting of the matrix occurs. Generally, the consolidation step is carried out at a temperature ranging from about 20° to 600° C., and preferably from about 250° to 550° C., the temperature being below the solidus temperature of the metal matrix. The Al-Li-Cu-Zn-Mg alloy composite containing silicon carbide reinforcements may be canless vacuum hot pressed at a temperature ranging from 275° to 475° C. and more preferably from 300° to 450° C., followed by forging or extrusion.

Those skilled in the art will appreciate that other time/temperature combinations can be used and that other variations in pressing and sintering can be employed. For example, instead of canless vacuum hot pressing the powder can be placed in metal cans, such as aluminum cans having a diameter as large as 30 cm or more, hot degassed in the can, sealed therein under vacuum, and thereafter reheated within the can and compacted to full density, the compacting step being conducted, for example, in a blind died extrusion press. In general any technique applicable to the art of powder metallurgy which does not invoke liquefying (melting) or partially liquefying the matrix metal can be used. Representative of such techniques are explosive compaction, cold isostatic pressing, hot isostatic pressing and direct powder extrusion.

The resultant aluminum-lithium based metal matrix composite may then be worked into structural shapes by forging, rolling, extrusion, drawing and similar metal working operations. Forming may be carried out at a temperature ranging from about 20° to 600° C., and preferably from about 250° to 450° C.

The part may then be heat treated to achieve the desired microstructure and concomitantly attain a desired strength. Conventional heat treatments for monolithic aluminum-lithium base alloys comprise the steps of solutionizing the shape at a temperature above the alloy's solvus temperature but below the degassing temperature to avoid possible blistering due to gas generation to homogenize the alloy; i.e., dissolve any precipitates or chemical gradient while retaining reinforcing phase, followed by rapid cooling, e.g. water quench to retain a supersaturated aluminum-based solid solution; optionally, stretching the shape by approximately 2% to promote homogeneous precipitation; and age hardening the shape at a temperature below the alloy's solvus temperature to promote precipitation therein of the primary strengthening phase, $Al_3(Li, Zr)$ or $\delta'$. The exact temperature to which the material is heated in the solutionizing step is not critical as long as there is a dissolution of intermetallic particles at this temperature. Solutionizing temperatures typically range from 500° to 600° C. The preferred age hardening temperature is from about 100° to 200° C. and the aging times. The exact aging temperature and time depends on the character and amounts of alloying elements present and the mechanical properties desired.

In certain cases, for instance applications in which increased abrasion resistance and modulus with lower strengths are required, the age hardening step can be carried out by natural aging at ambient temperatures. Preferably, aging times for composites containing 5 and 15 volume percent reinforcing particles or fibers correspond to 0.5t–0.65t and 0.0t to 0.2t, respectively, where t corresponds to the time necessary to achieve peak hardness and strength during aging of a monolithic alloy composed of the metal matrix, at a temperature ranging from about 100° to 200° C. Aging for times longer than those corresponding to times required to reach peak hardness or strength leads to degradation of mechanical properties resulting from excessive particle coarsening (leading to lower strength) or dissolution and reprecipitation of the equilibrium AlLi phase or $\delta$, at grain or subgrain boundaries (leading to lower ductilities). Processes of this type for heat treating processes of aluminum-lithium based alloys are taught by U.S. application Ser. No. 112,029 filed Oct. 23, 1987 by Kim et al., and in the publication by Kim et al. "Structure and Properties of Rapidly Solidified Aluminum-Lithium Alloys", J. de Physique, C3, 9, 48, p. 309, September 1987. The heat treatment of rapidly solidified monolithic aluminum-lithium base alloys said by Kim et al. to produce the best combination of hardness, strength and ductility comprises the steps of solutionizing the alloy at 550° C. for 2 hours, quenching in an ince water bath and age hardening the alloy at 130° C. for 16 hours.

The following examples are presented to provide a more complete understanding of the invention. The specific techniques, conditions, materials, proportions and reported data set forth to illustrate the principles and practice of the invention are exemplary and should not be construed as limiting the scope of the invention. All alloy compositions described in the specification and examples are nominal compositions.

EXAMPLE I

Figure 1B:
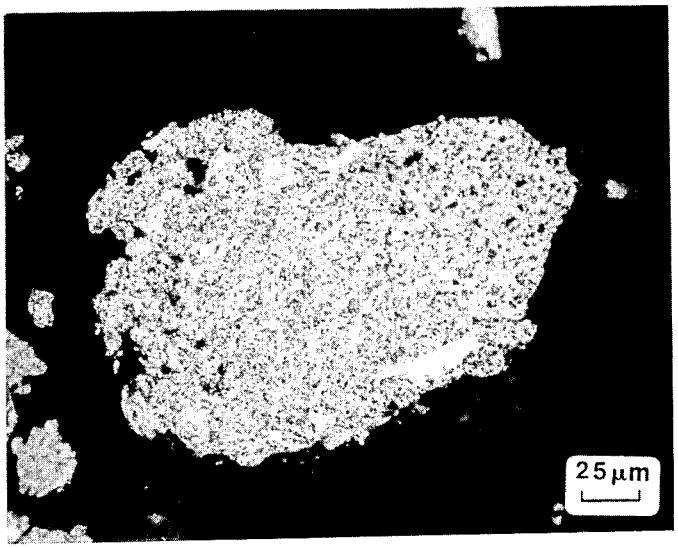

Five gram samples of −40 mesh (U.S. standard sieve size) powder of the composition aluminum-balance, 10.28 at. % lithium, 0.14 at. % zirconium, 0.39 at. % copper and 0.51 at. % magnesium (hereinafter designated alloy A) are produced by comminuting rapidly solidified planar flow cast ribbon. The comminuted powder was added to either 0.34 grams or 1.13 grams of silicon carbide particulate, corresponding approximately to 5 and 15 volume percent particulate reinforcement, respectively. The samples were processed in sequence by pouring them into a Spx Industries hardened steel vial (model #8001) containing 31 grinding balls. Each of the balls had a diameter of about 0.365 cm and were composed of alloy SAE 52100 steel. The filled vials were then sealed and placed into a Spex Industries Model #8000 Mixer/Mill. Each powder batch containing 5 and 15 vol. % SiC particulate was then processed for 90 minutes. No processing control agent such as stearic acid was used to control dispersion of the reinforcing phase. The processing procedure described above provided a composite aluminum-lithium base alloy with silicon carbide particulate in the form of powder particles that exhibited a substantially uniform dispersion of reinforcement, and strong metal to silicon carbide particulate bonding. Photomicrographs of said composite powder particles containing 5 and 15 vol. % silicon carbide paticulate that have been processed for 90 minutes are shown in FIGS. 1A and 1B, respectively.

EXAMPLE II

Figure 2A:
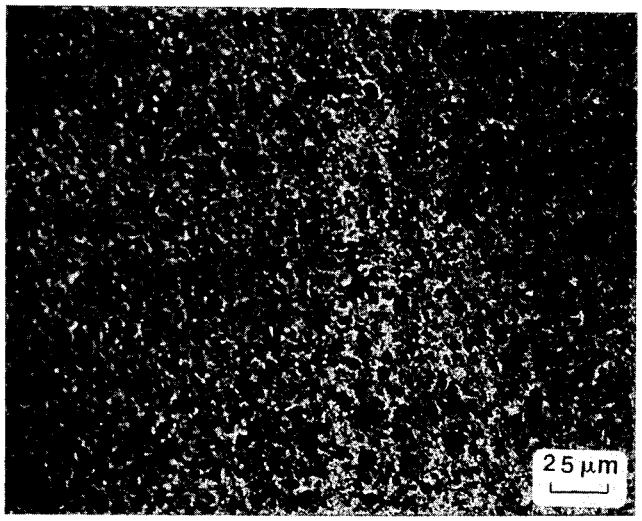
FIGS. 2A and 2B are photomicrographs of extruded aluminum based, lithium, zirconium, copper and magnesium containing alloy having, respectively, 5 and 15 percent by volume silicon carbide particulate.
Figure 2B:
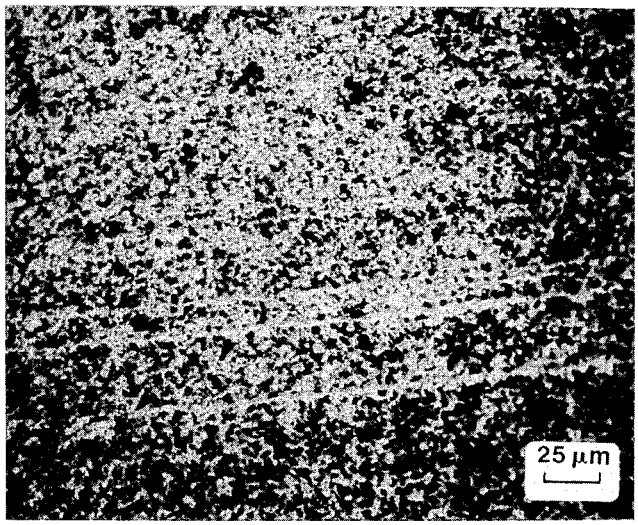

The procedure described in Example I was used to produce two 300 gram batches of aluminum-lithium based silicon carbide particulate composite powder particles. Batches contained 5 and 15 vol. % silicon carbide particulate reinforcement. In addition, a batch of non-reinforced, non-ball milled monolithic alloy A powder was included as a standard for the study. Each of the batches was then vacuum hot pressed into a billet having a diameter of 7.62 cm. The billets were heated to a temperature of 350° C. and extruded through Alloy H-13 tool steel dies heated to a temperature of about 350° C. to form 1.59 cm diameter rods. As shown by the small dark spots in the photomicrographs of FIGS. 2A and 2B, for the 5 and 15 vol. % silicon carbide reinforced extrusions, respectively, the silicon carbide particulate reinforcement is extremely fine and is distributed substantially uniformly throughout the aluminum-lithium base matrix. The fineness and substantial uniformity of particulate dispersion was not adversely affected or substantially increased by the extrusion.

EXAMPLE III

To determine the effect of aging time on microhardness, samples of rods produced in accordance with the procedure described in Example II were subjected to a solutionizing heat treatment at 550° C. for 2 hours, quenched in an ice water bath, and then age hardened for various lengths of time at 130° C. Samples include monolithic alloy A, Alloy A plus 5 vol. % SiC and Alloy A plus 15 vol. % SiC. Monolithic Alloy A represents a non-reinforced, non-ball milled powder that was vacuum hot pressed and extruded. Composite Alloy A-Sic samples were ball milled for 90 minutes, vacuum hot pressed and extruded. Microhardness measurements were made on a Leitz Miniload II Hardness Tester with a Vickers hardness indenter under a 490.3 MN load.

Figure 3:
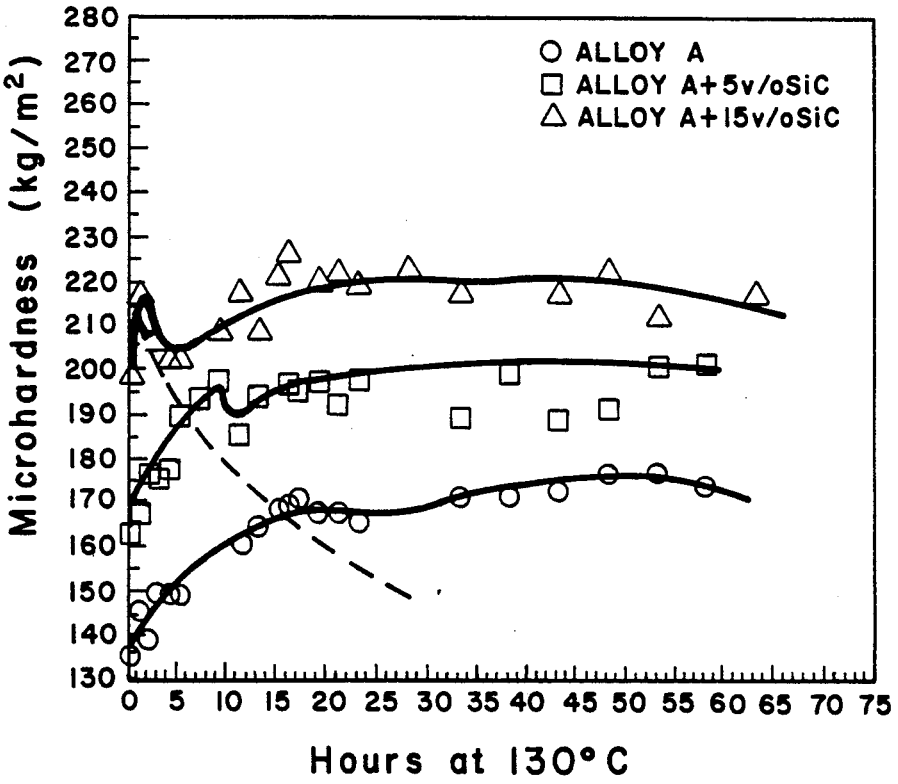
FIG. 3 is a graph depicting the response in microhardness of extruded aluminum-lithium-copper-magnesium-zirconium alloy containing 5 and 15 volume percent $SiC_p$ prepared by the present invention, as well as for extruded monolithic aluminum-lithium-copper-magnesium-zirconium alloy, as a function of aging time at 130° C.

The response in microhardness of extruded monolithic aluminum-lithium-copper-magnesium-zirconium alloy as well as for extruded aluminum-lithium-copper-magnesium-zirconium alloy containing 5 and 15 volume percent $SiC_p$ prepared by the present invention as a function of aging time at 130° C. are shown in FIG. 3. As may be seen, each of the hardness profiles in FIG. 3 exhibits a double hump. The first hump, corresponding to aging at 130° C. 16 hrs. for the monolithic alloy A; 10 hrs. of aging at 130° C. for alloy A+5 vol. % SiC; and 2 hrs. aging at 130° C. for alloy A+15 vol. % SiC, represents peak hardness corresponding to the precipitation of the alloys primary strengthening phase δ' [$Al_3$(Li, Zr)]. Aging times for the composite containing 5 and 15 volume percent reinforcing particles or fibers correspond to 0.625t and 0.12t, where t equals 16 hrs., the time necessary to achieve peak hardness and strength during aging of monolithic alloy A at 130° C. In this peak aged condition, the alloy exhibits an optimum combination of strength, hardness and ductility. The second broader hump having a peak corresponding to 48 hrs., aging at 130° C. for the monolithic alloy A; 17 hrs. aging at 130° C. for alloy A+5 vol. % SiC, and 14 hrs. aging at 130° C. for alloy A+15 vol. % SiC, represents precipitation of the equilibrium δ phase (AlLi) in the samples. This phase primarily precipitates at grain boundaries and typically leads to increased brittleness.

EXAMPLE IV

Differential scanning calorimetry (DSC) was performed on samples of extruded rod produced in the manners set forth in Examples I and II. DSC is a technique readily used to study the thermal behavior of materials as they undergo physical and chemical changes during heat treatment. Specifically DSC measures the amount of heat that is involved as a material undergoes either an endothermic (absorption of heat) or an exothermic (evolution of heat) reaction. In the present example, the two primary solid state transformations that were observed included (i) precipitation (exothermic) and (ii) particle coarsening (endothermic) reactions.

Samples examined in the present investigation included monolithic Alloy A, Alloy A plus 5 vol. % SiC and Alloy A plus 15 vol. % SiC. Samples examined were in the as-solutionized condition (aged at 550° C. for 2 hours and quenched in an ice water bath) or in the as-solutionized condition, quenched in an ice water bath, and aged at 130° C. for times in excess of times required to reach peak-aged condition as determined in Example III. Specifically, the times required to reach the peak-aged condition were about 16 hrs. at 130° C. for the monolithic alloy A; 10 hrs. at 130° C. for alloy A+5 v/o SiC; and 2 hrs. at 130° C. for monolithic alloy A+15 vol. % SiC.

Figure 4:
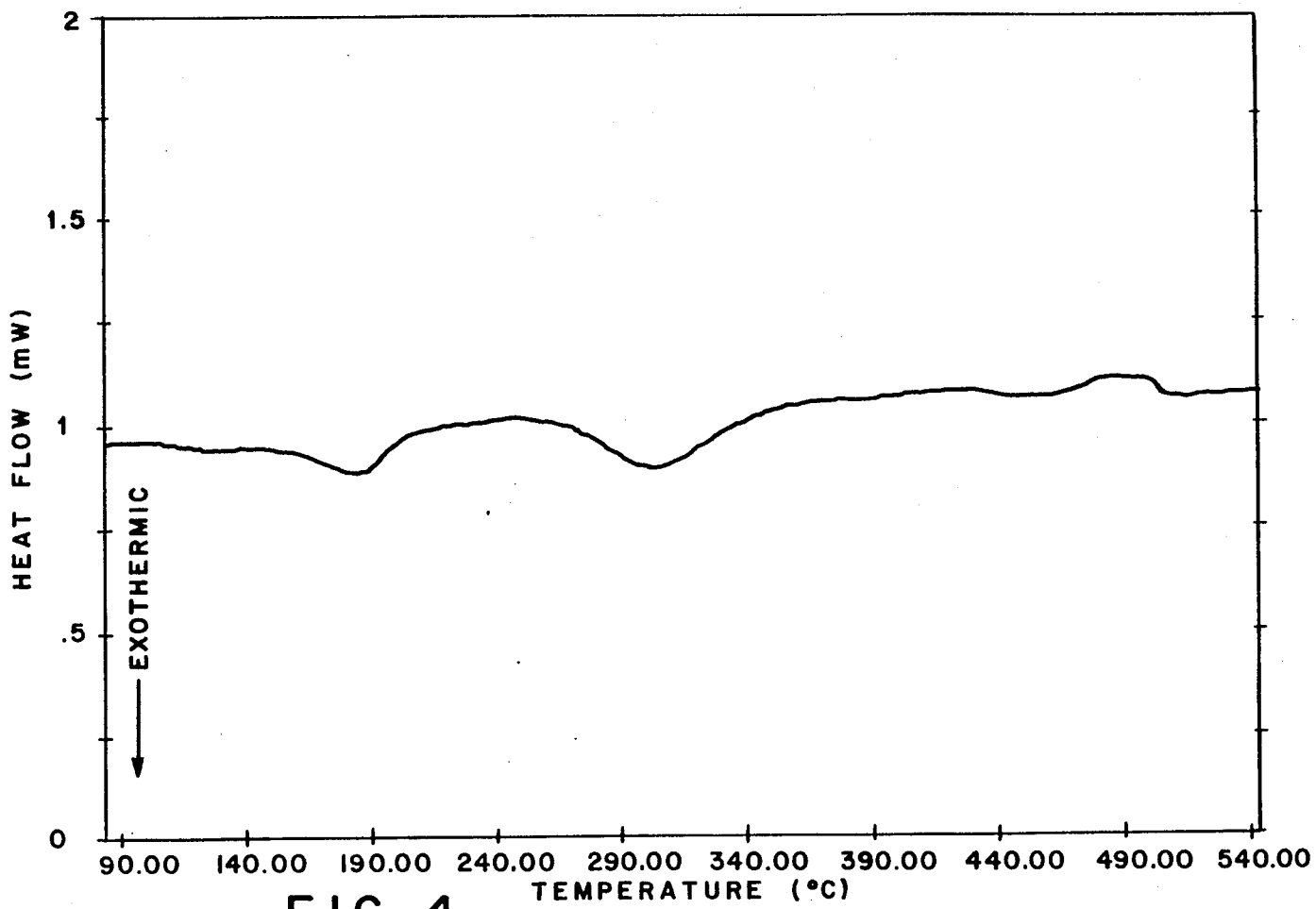
FIG. 4 is a differential scanning calorimetry trace of a monolithic, extruded aluminum-lithium-copper-magnesium-zirconium alloy that has been solutionized at 550° C. for 2 hours and then immediately quenched into an ice water bath.

A differential scanning calorimetry trace of a monolithic, extruded aluminum-lithium-copper-magnesium-zirconium alloy (Alloy A) for a sample which has been solutionized at 550° C. for 2 hours and immediately quenched in an ice water bath is shown in FIG. 4. The DSC trace, corresponding to the change in heat flow (units of milliwatts) as the sample is heated from about 90° C. to about 540° C., has been normalized for a one gram sample and corrected for the DSC trace corresponding to the pure Al pan which physically contains the sample. As evidenced by the DSC trace in FIG. 4, two strong exothermic reactions having onset temperatures of about 150° C. and 270° C., corresponding to the precipitation of $Al_3$(Li, Zr) [δ'] and AlLi [δ] phases, respectively, are very apparent.

Figure 5:
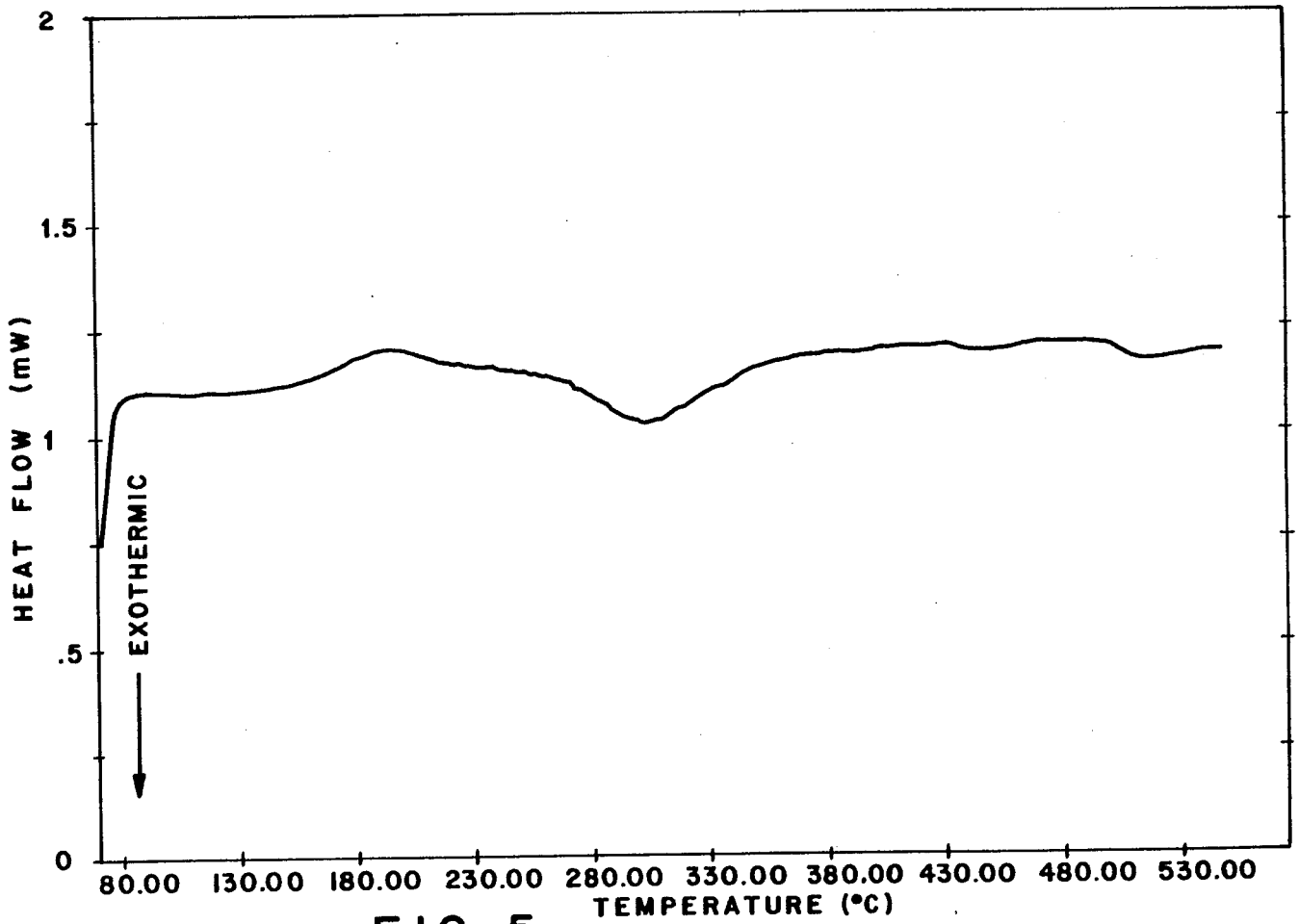
FIG. 5 is a differential scanning calorimetry trace of a monolithic, extruded aluminum-lithium-copper-magnesium-zirconium alloy that has been solutionized at 550° C. for 2 hours and then immediately quenched into an ice water bath and aged at 130° C. for 30 hours.

A differential scanning calorimetry trace of a monolithic, extruded aluminum-ltihium-copper-magnesium-zirconium alloy (Alloy A) that has been solutionized at 550° C. for 2 hours, quenched in an ice water bath, and aged at 130° C. for 30 hours (beyond peak aged condition) is shown in FIG. 5. As evidenced by the DSC trace in FIG. 5, the exothermic reaction corresponding to the precipitation of $Al_3(Li, Zr)$ [δ'] is completely absent, all δ' having been precipitated. In fact, a strong endotherm with an onset temperature of about 170° C., corresponding to δ' coarsening, is apparent.

Figure 6:
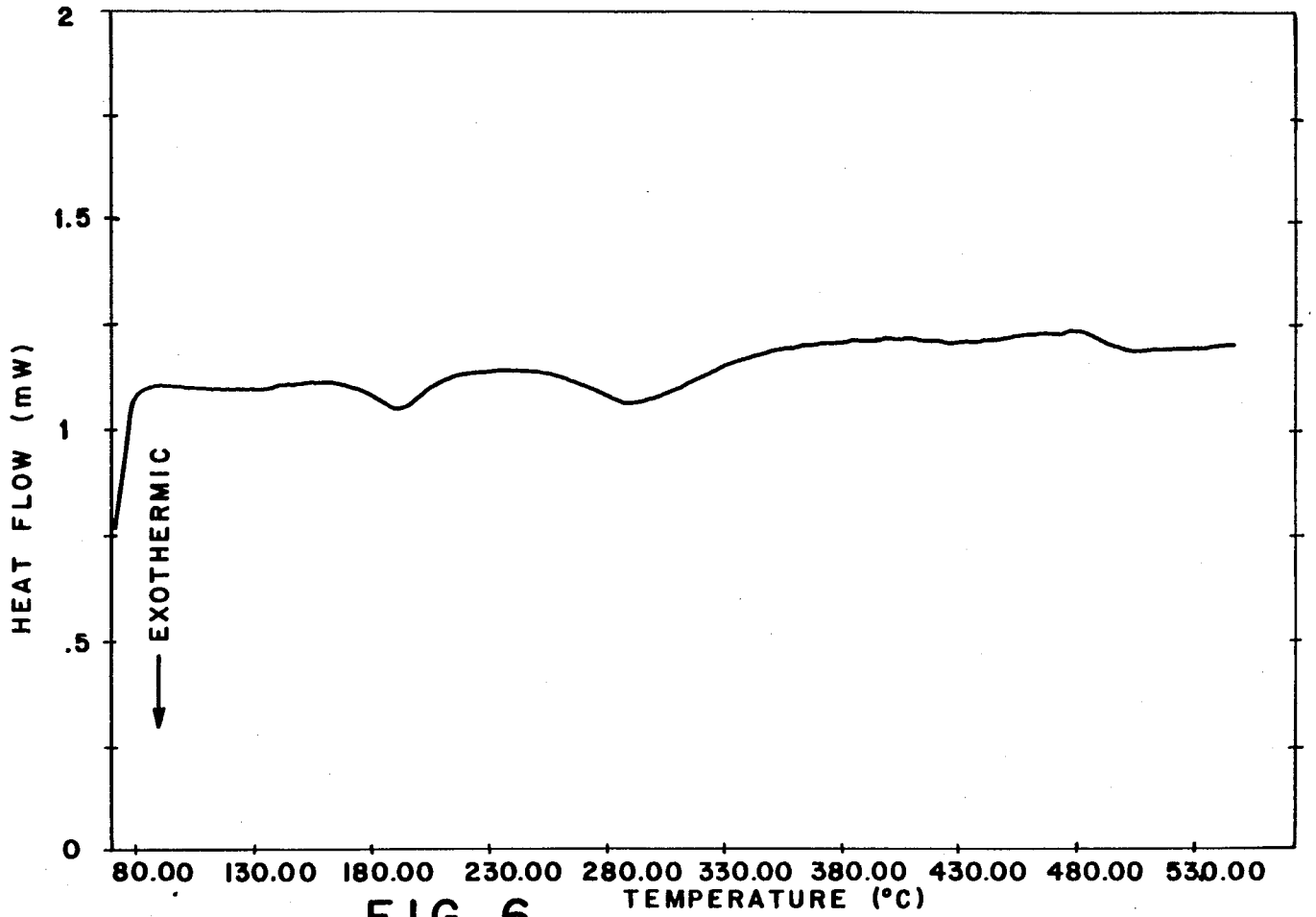
FIG. 6 is a differential scanning calorimetry trace of an extruded aluminum-lithium-copper-magnesium-zirconium alloy containing 5 vol. % $SiC_p$ that has been solutionized at 550° C. for 2 hours and then immediately quenched into an ice water bath.

A differential scanning calorimetry trace of an extruded aluminum-lithium-copper-magnesium-zirconium alloy (Alloy A) containing 5 vol. % SiC particulate for a sample which has been solutionized at 550° C. for 2 hours and quenched in an ice water bath is shown in FIG. 6. The DSC trace, corresponding to the change in heat flow (units of milliwatts) as the sample is heated from about 80° C. to about 540° C., has been normalized for a one gram sample and corrected for the DSC trace corresponding to the pure Al pan which physically contains the sample. As evidenced by the DSC trace of FIG. 6, two strong exothermic reactions with onset temperatures of about 150° C. and 250° C., corresponding to the precipitation of $Al_3(Li, Zr)$ [δ'] and AlLi [δ] phases, respectively, are very apparent.

Figure 7:
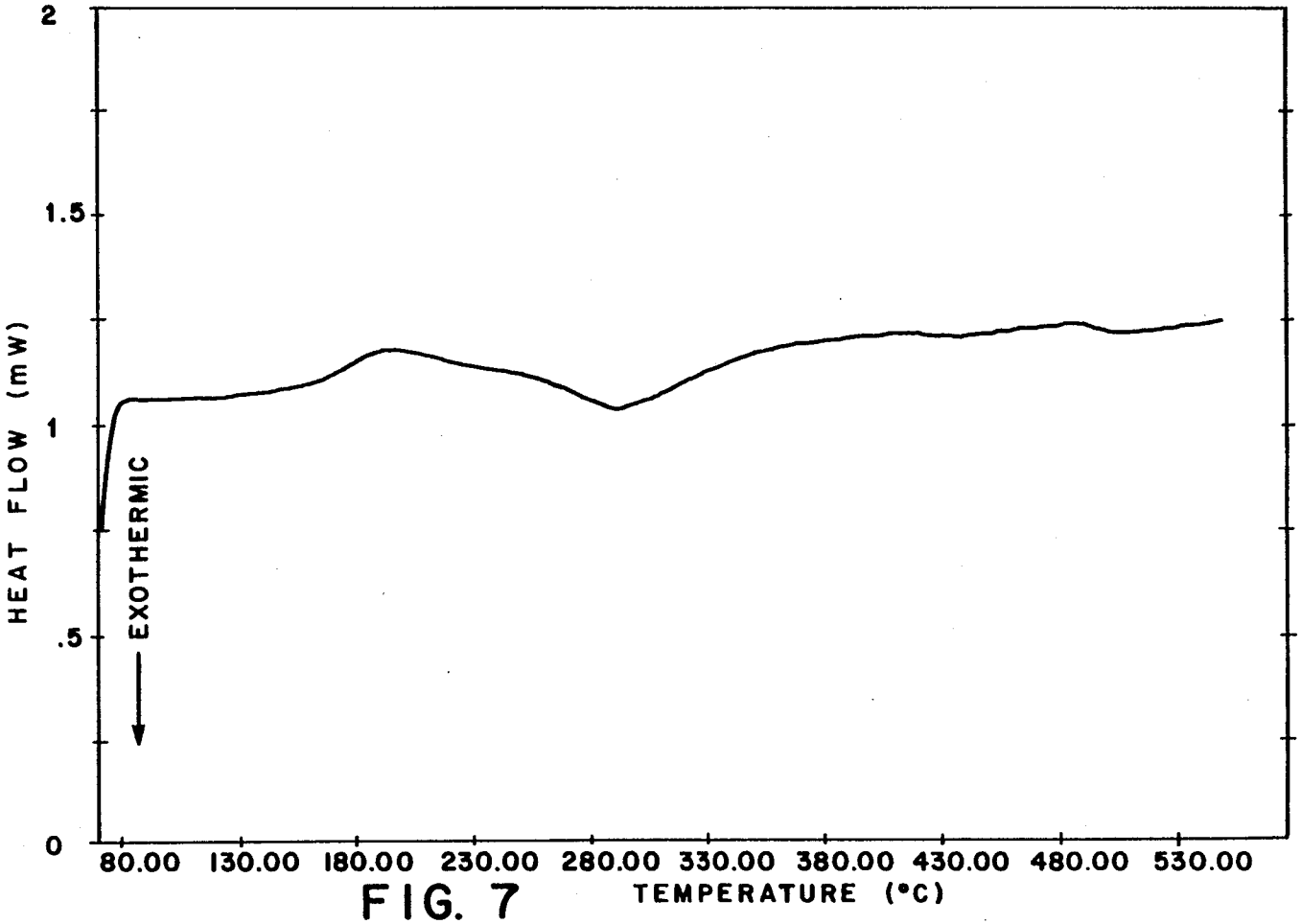
FIG. 7 is a differential scanning calorimetry trace of an extruded aluminum-lithium-copper-magnesium-zirconium alloy containing 5 vol. % $SiC_p$ that has been solutionized at 550° C. for 2 hours and then immediately quenched into an ice water bath and aged at 130° C. for 14 hours.

A differential scanning calorimetry trace of an extruded aluminum-lithium-copper-magnesium-zirconium alloy (Alloy A) containing 5 vol. % SiC particulate solutionized at 550° C. for 2 hours, quenched in an ice water bath, and aged at 130° C. for 14 hours (beyond peak aged condition) is shown in FIG. 7. As evidenced by the DSC trace in FIG. 7, the exothermic reaction corresponding to the precipitation of $Al_3(Li, Zr)$ [δ'] is completely absent, all δ' having been precipitated. In fact, a strong endotherm with an onset temperature of about 170° C., corresponding to δ' coarsening is apparent.

Figure 8:
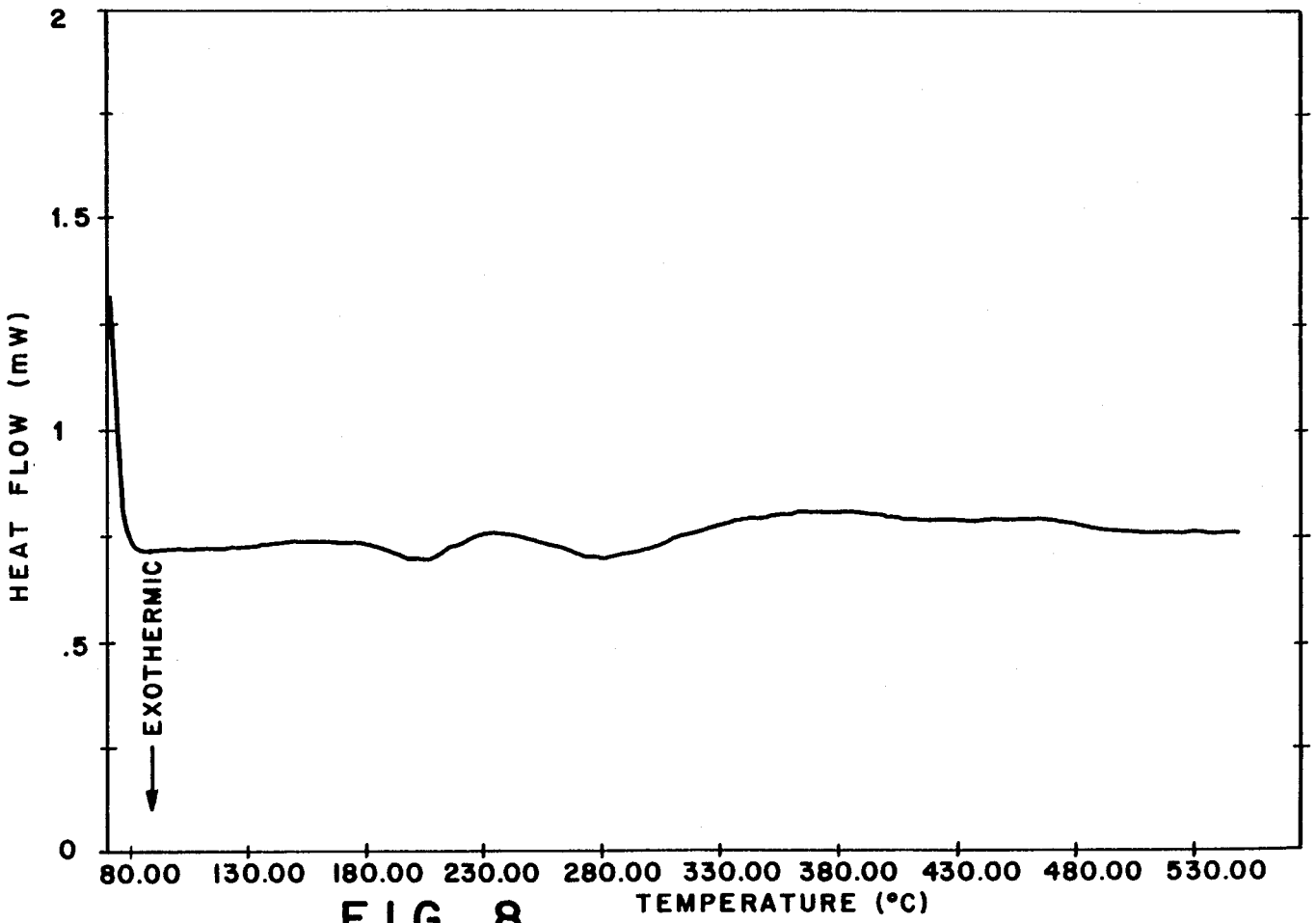
FIG. 8 is a differential scanning calorimetry trace of an extruded aluminum-lithium-copper-magnesium-zirconium alloy containing 15 vol. % $SiC_p$ that has been solutionized at 550° C. for 2 hours and then immediately quenched into an ice water bath.

A differential scanning calorimetry trace of an extruded aluminum-lithium-copper-magnesium-zirconium alloy (Alloy A) containing 15 vol. % SiC particulate for a sample which has been solutionized at 550° C. for 2 hours and immediately quenched in an ice water bath is shown in FIG. 8. The DSC trace, corresponding to the change in heat flow (units of milliwatts) as the sample is heated from about 80° C. to about 540° C., has been normalized for a one gram sample and corrected for the DSC trace corresponding to the pure Al pan which physically contains the sample. By comparison to the DSC traces for monolithic Alloy A and Alloy A containing 5 vol. % SiC particulate where two distinct exothermic reactions are observed (FIGS. 3 and 5, respectively), the DSC trace for the sample of Alloy A containing 15 vol. % SiC also indicates two strong exothermic reactions with onset temperatures of about 170° C. and 240° C., corresponding to the precipitation of $Al_3(Li, Zr)$ [δ'] and [δ'] phases, respectively. This data indicates that quenching from the solutionizing temperature was sufficient to significantly suppress the precipitation of either δ' of δ phase.

Figure 9:
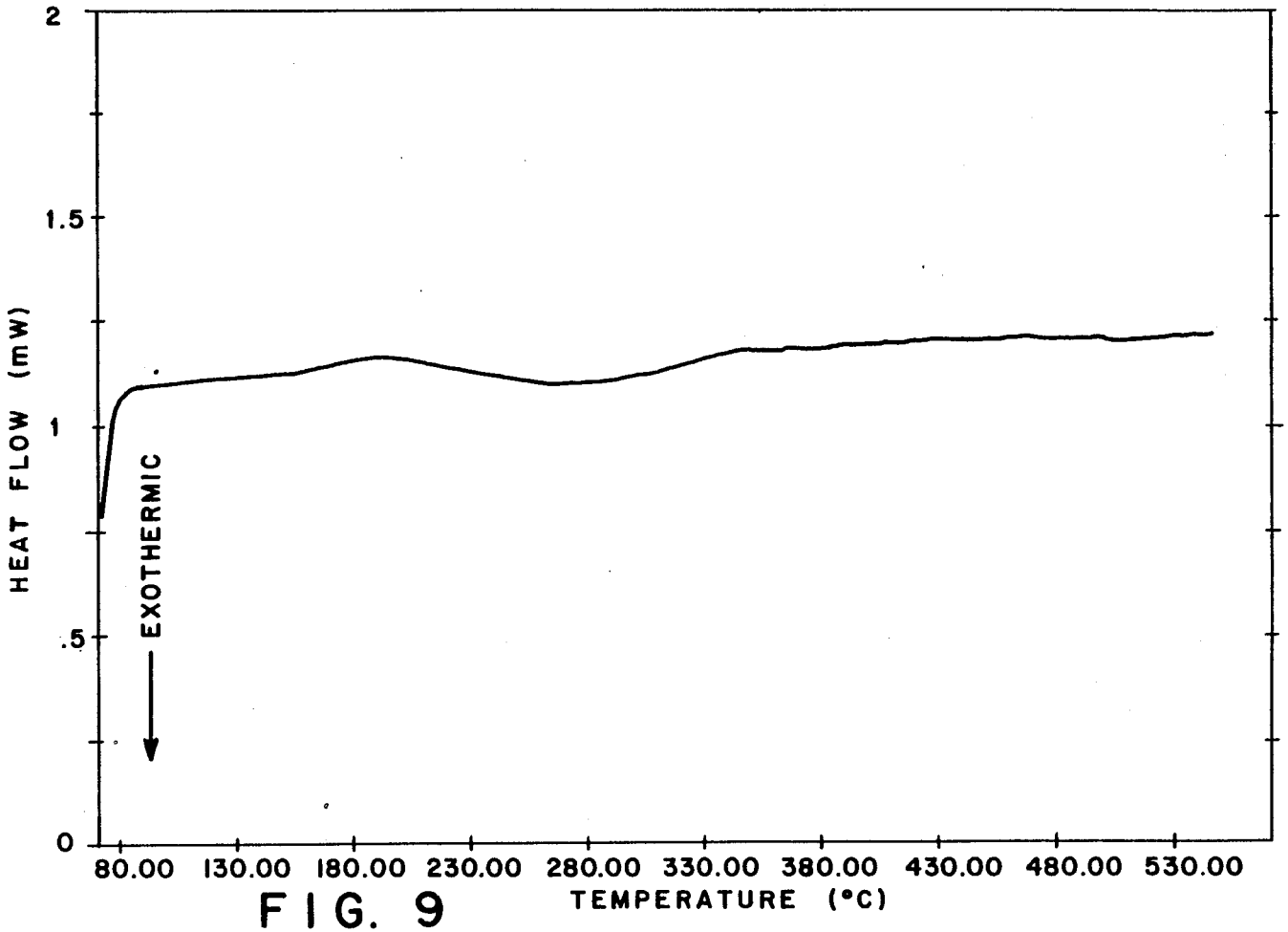
FIG. 9 is a differential scanning calorimetry trace of an extruded aluminum-lithium-copper-magnesium-zirconium alloy containing 15 vol. % $SiC_p$ that has been solutionized at 550° C. for 2 hours and then immediately quenched into an ice water bath and aged at 130° C. for 5 hours.

A differential scanning calorimetry trace of an extruded aluminum-lithium-copper-magnesium-zirconium alloy (Alloy A) containing 15 vol. % SiC particulate solutionized at 550° C. for 2 hours, quenched in an ice water bath, and aged at 130° C. for 5 hours (beyond peak aged condition) is shown in FIG. 9. As evidenced by the DSC trace of FIG. 9, the exothermic reaction corresponding to the precipitation of $Al_3(Li, Zr)$ [δ'] is completely absent, and δ' having been precipitated. In fact, a strong endotherm with an onset temperature of about 140° C. corresponding to δ' coarsening is apparent.

The DSC results presented in FIGS. 4–9 agree well with the data and aging profile determined by microhardness after aging at 130° C., as presented in Example III. Aging at 130° C. for times in excess of those predicted and corresponding to peak hardness (peak-aged) condition, clearly results in the complete formation of the desired δ' phase. Thus, the presence of silicon carbide particulate dispersed into the matrix by the manner described in Example I does promote a significant increase in aging kinetics. In fact, the kinetics for precipitation of δ' in Alloy A containing 15 vol. % SiC particulate are so rapid that aging at 130° C. for 14 and 5 hours, respectively, was sufficient to precipitate the $Al_3(Li, Zr)$ [δ'] phase.

EXAMPLE V

Rods produced in accordance with the procedure described in Example II were subjected to tensile tests at room temperature to determine their tensile properties, including values of 0.2 percent yield strength (Y.S.), ultimate tensile strength (U.T.S.) and ductility (% elongation). Tensile tests were performed on an Instron Model 1125 tensile machine interfaced with a Digital PDP-11 data aquisition computer. Samples tested in the present invention included monolithic Alloy A, Alloy A plus 5 vol. % SiC and Alloy A plus 15 vol. % SiC. Samples tested were in the as-solutionized condition (aged at 550° C. for 2 hours and quenched in an ice water bath) or in the as-solutionized condition and aged at 130° C. for times corresponding to an under-aged condition (i.e., times less than peak aged condition), a peak-aged condition and an over-aged condition (i.e., times greater than peak-aged condition). The results of the tensile tests for the monolithic Alloy A rods and rods containing particulate reinforcement are set forth in Table I.

As shown by the data of Table I, aging times at 130° corresponding to peak-aged condition for monolithic Alloy A, Alloy A plus 5 vol. % SiC and Alloy A plus 15 vol. % SiC are in complete agreement with predictions of the microhardness results (Example III). For monolithic Alloy A, peak strength with good levels of ductility are achieved after aging at 130° C. for 16 hours. For Alloy A plus 5 vol. % SiC particulate, near peak levels of strength and acceptable ductilities are achieved after aging for 9 hours at 130° C. Aging for longer times leads to a decrease in either strength, ductility or both. For Alloy A plus 15 vol. % SiC particulate near peak levels of strength and acceptable ductilities are achieved after aging for 2 hours at 130° C. Aging for longer times leads to a slight increase in strength, yet a decrease in ductility by a factor of 2.

TABLE I

Ambient Temperature Tensile Properties of Monolithic Alloy A and Alloy A plus 5 and 15 vol. % SiC Particulate.

| Vol. % $SiC_p$ | Condition | YS (MPa) | UTS (MPa) | Elong. (%) |
|---|---|---|---|---|
| mono- | 550° C. 2 hrs./quench | 234 | 358 | 6 |
| lithic | 10 hrs. @ 130° C. | 441 | 469 | 4 |
| mono- | *16 hrs. @ 130° C. | 461 | 517 | 6 |
| lithic | 27 hrs. @ 130° C. | 489 | 496 | 1 |
| 5 | 550° C. 2 hrs./quench | 392 | 469 | 6.5 |
| 5 | 5 hrs. @ 130° C. | 544 | 531 | 1.2 |
| 5 | *9 hrs. @ 130° C. | 578 | 586 | 2.2 |
| 5 | 11 hrs. @ 130° C. | 586 | 592 | 0.8 |
| 5 | 16 hrs. @ 130° C. | 482 | 524 | 1.7 |
| 15 | 550° C. 2 hrs./quench | 469 | 503 | 0.5 |
| 15 | 1 hr. @ 130° C. | 517 | 544 | 0.7 |
| 15 | *2 hrs. @ 130° C. | 571 | 586 | 0.4 |

TABLE I-continued

Ambient Temperature Tensile Properties of Monolithic Alloy A and Alloy A plus 5 and 15 vol. % SiC Particulate.

| Vol. % $SiC_p$ | Condition | YS (MPa) | UTS (MPa) | Elong. (%) |
|---|---|---|---|---|
| 15 | 16 hrs. @ 130° C. | 592 | 606 | 0.2 |

*Corresponds to samples in a Peak-aged condition.

Having thus described the invention in rather full detail, it will be understood that such detail need not be strictly adhered to but further changes and modifications may suggest themselves to one skilled in the art, all falling within the scope of the present invention as defined by the subjoined claims.

We claim:

1. A process for producing a composite having a metal matrix and a reinforcing phase, comprising the steps of:

(a) forming a charge containing, as ingredients, a rapidly solidified aluminum-lithium based alloy and particles of a reinforcing material present in an amount ranging from about 0.1 to 50 percent by volume of said charge;

(b) ball milling the charge energetically to enfold metal matrix material around each of said particles while maintaining the charge in a pulverulant state;

(c) consolidating said charge to provide a mechanically formable, substantially void-free mass;

(d) subjecting said mass to a heat treatment comprising the steps of:

(i) solutionizing said mass at a temperature above the solvus temperature of said alloy;

(ii) rapid cooling said mass;

(iii) age hardening said mass at a temperature below the solvus temperature of said alloy to promote precipitation of a primary strengthening $Al_3(Li, Zr)$ phase into said metal matrix.

2. A process as recited in claim 1, wherein said rapidly solidified aluminum-lithium based alloy is prepared by a process comprising the steps of forming a melt of the aluminum-lithium based alloy and quenching the melt on a moving chill surface at a rate of at least about $10^5$° C./sec.

3. A process as recited in claim 1, wherein, during heat treatment, said mass is rapidly cooled in an ice water bath.

4. A process as recited in claim 3, wherein said ball milling step is continued until said particles are enveloped in and bonded to said matrix material.

5. A process as recited in claim 4, wherein said consolidation step is carried out at a temperature ranging from about 250° to 550° C. said temperature being below the solidus temperature of said metal matrix.

6. A process as recited in claim 5, wherein said consolidation step comprises vacuum hot pressing at a temperature ranging from about 275° to 475° C.

7. A process as recited in claim 1, wherein said rapidly solidified aluminum-lithium based alloy is selected from the group consisting essentially of the formula $Al_{bal}Zr_aLi_bMg_cT_d$, wherein T is at least one element selected from the group consisting of Cu, Si, Sc, Ti, B, Hf, Be, Cr, Mn, Fe, Co and Ni, "a" ranges from about 0.05–0.75 at.%, "b" ranges from about 9.0–17.75 at.%, "c" ranges from about 0.45–8.5 at.% and "d" ranges from about 0.05–13 at.%, and the balance being aluminum plus incidental impurities.

8. A process as recited in claim 1, wherein said rapidly solidified aluminum-lithium based alloy is selected from the group consisting essentially of the formula $Al_{bal}Zr_aLi_bMg_cCu_d$, wherein "a" ranges from about 0.05–0.75 at.%, "b" ranges from about 9.0–17.75 at.%, "c" rages from abut 0.45–8.5 at.% and "d" ranges from about 0.05–13 at. %, the balance being aluminum plus incidental impurities.

9. A process as recited in claim 4 wherein said particles are selected from the group consisting of carbides, borides, nitrides, oxides and intermetallic compounds.

10. A process as recited in claim 9, wherein said particles are selected from the group consisting of silicon carbide and boron carbide particles.

11. A process as recited in claim 4, wherein said particles of reinforcing material are substantially uniformly distributed within said matrix material.

12. A process as recited in claim 3, wherein said solutionizing heat treatment step is carried out at a temperature ranging from about 425° C. to 600° C. for a period of time sufficient to substantially homogenize the alloy, disolving most of the intermetallic particles therein.

13. A process as recited in claim 12, further comprising the step of stretching said solutionized alloy.

14. A process as recited in claim 3, wherein said age hardening is carried out by natural aging at ambient temperatures.

15. A process as recited in claim 3, wherein said age hardening is carried out at a temperature ranging from about 100° to 200° C. for a period of time sufficient to achieve the desired properties.

16. A process as recited in claim 15, wherein said age hardened aluminum-lithium metal matrix has an $Al_3(Li, Zr)$ phase and said age hardening is carried out for a time period sufficient to achieve desired properties.

17. A process as recited in claim 15, wherein the time necessary to achieve a maximum combination of hardness, strength and ductility for a composite containing 5 and 15 vol. % reinforcing particles or fibers corresponds to 0.5t to 0.65t and 0.0t to 0.2t, respectively, where t corresponds to the time necessary to achieve peak hardness and strength during aging of a monolithic alloy composed of said metal matrix at a temperature ranging from about 100° to 200° C.

18. A process as recited in claim 17, wherein said time period of said solutionizing step ranges from about 1 to 24 hours.

19. A process as recited in claim 15, wherein the time necessary to achieve a maximum combination of hardness, strength and ductility for said composite is some fraction of the time necessary to achieve peak hardness and strength during aging of a monolithic alloy composed of said metal matrix at a temperature ranging from about 100° to 200° C., said fraction being less than 1.

* * * * *